United States Patent [19]

Kaido et al.

[11] 4,014,185

[45] Mar. 29, 1977

[54] METHOD OF MANUFACTURING KNITTED LONG-PILE FABRICS AND FABRICS MADE BY THE METHOD

[75] Inventors: Tsutomu Kaido, Sakai; Seiichi Asahi, Ashiya; Sinjiro Nishikawa, Kobe, all of Japan

[73] Assignee: Kanegafuchi Kagaku Kogyo Kabushiki Kaisha, Japan

[22] Filed: Sept. 19, 1974

[21] Appl. No.: 507,612

[52] U.S. Cl. ..... 66/84 R

[51] Int. Cl.[2] ..... D04B 23/06; D04B 23/08; D04B 23/10; D04B 23/12

[58] Field of Search ..... 66/87, 88, 83, 84, 91

[56] References Cited

UNITED STATES PATENTS

| | | | |
|---|---|---|---|
| 2,892,331 | 6/1959 | Kelly | 66/91 X |
| 2,892,331 | 6/1959 | Kelly | 66/147 X |
| 2,907,191 | 10/1959 | MacCaffray | 66/85 R |
| 2,931,197 | 4/1960 | Newman | 66/87 |
| 3,055,196 | 9/1962 | Brunner et al. | 66/84 |
| 3,646,782 | 3/1972 | Kohl | 66/87 |
| 3,855,820 | 12/1974 | Kohl | 66/87 |

FOREIGN PATENTS OR APPLICATIONS

| | | | |
|---|---|---|---|
| 48-25390 | 7/1973 | Japan | 66/84 R |
| 1,157 | 5/1856 | United Kingdom | 66/84 R |

*Primary Examiner*—Ronald Feldbaum
*Attorney, Agent, or Firm*—Robert E. Burns; Emmanuel J. Lobato; Bruce L. Adams

[57] ABSTRACT

A long-pile fabric having pile longer than 10 cm can be obtained by knitting with a warp knitting machine, in which guides for pile yarn provided separately from the group of guides for knitting ground stitches swing back-and-forth in their own motion between the rear of the position where ground stitches are formed and the front of a pile cutting means which is provided at a variable distance in front of the ground-stitch forming position to form pile loops on the ground stitches, and the formed pile loops are cut by the cutting means to form pile.

Further, a knitted fabric having pile distributed in a desired pattern is obtained by grouping the guides for pile yarn into a lot of groups along the guide bar and thus controlling the pile points separately with respect to the groups by means of punch cards.

8 Claims, 11 Drawing Figures

METHOD OF MANUFACTURING KNITTED LONG-PILE FABRICS AND FABRICS MADE BY THE METHOD

This invention relates to a novel method of knitting warp-knitted pile fabrics used for carpeting, imitation hair, wigs, jackets, hoods, capes, sweaters, boots, false mustaches and beards, toys, veils, etc., in particular, such fabrics as having a longer pile length of more than 10 cm in comparison with that of conventional one, and to the warp-knitted pile fabrics made by the method.

It is widely known that fabrics with pile such as ordinary pile fabrics and pile carpets are manufactured by a cut-pile knitter or tufting machine and are on the market. These fabrics, however, are limited in pile length, being variable merely in a range of short pile length mostly under 10 cm.

Recently, it has been attempted to make pile fabrics, taking the advantage of a warp knitting machine, by knitting pile yarns into the fabric to form pile, and goods made thereby have partly appeared on the market. But those fabrics too are limited in pile length, being technically impossible to form long pile exceeding 10 cm, and it is substantially impossible to vary the pile length as desired.

Further, a conventional cut-pile knitter, although it permits easy knife-cutting of pile under tension for relatively short pile length, cannot enable the knitting of satisfactory pile fabrics of longer pile by cutting under tension, because the cut ends of the pile are apt to rebound towards the position where ground stitches are being formed and to be knitted into them or to cause frizzes or tangles due to the elongation of the pile yarn.

It is an object of the present invention to provide a novel method of effectively and readily knitting a warp knitted fabric having longer pile, which has been considered technically difficult.

Another object of the present invention is to provide an effective means which, being able to form longer pile and to change the pile length in a wide range for 3 to 50 cm, enables the knitting of various warp knitted fabrics having pile of various length.

Still another object of the present invention is to provide a means of knitting a novel warp-knitted pile fabric having long pile formed and arranged on the ground texture according to a desired pattern.

Further objects of the present invention is to provide warp-knitted pile fabrics knitted by the methods described above and having far longer pile in comparison with the conventional ones.

According to one aspect of the present invention to attain above objects, there are provided in a warp knitting machine guide bars for pile yarns separately from the group of guide bars for knitting the ground stitches and movably is separate back — and — forth motion and a pile setting plate with cutting mechanism which are movable so as to change the cut length of the pile as desired.

Further, the invention has a feature that the guides for pile yarn are grouped into a lot of groups so as to control the pile points separately with respect to each group by means of a punch card etc.

Other features and embodiments of the invention will be apparent from the following description taken in connection with the accompanying drawings, wherein:

FIG. 1 to FIG. 6 are illustrations showing successively the steps of one mode of stitch forming according to the invention, in which FIG. 1 shows the loop forming at a knife pointed bar, FIG. 2 shows a latch needle bar in rising motion, FIG. 3 shows the latch needle with the latch open, FIG. 4 shows the next step where the overlapping around the latch needle has began, and FIG. 5 and 6 show the knock over and under lap respectively.

In FIG. 1 to 6, 1 is a knife pointed bar in the warp knitting machine, 2 is a pile setting plate and 3 is a guide bar for pile yarn.

Figure 1:
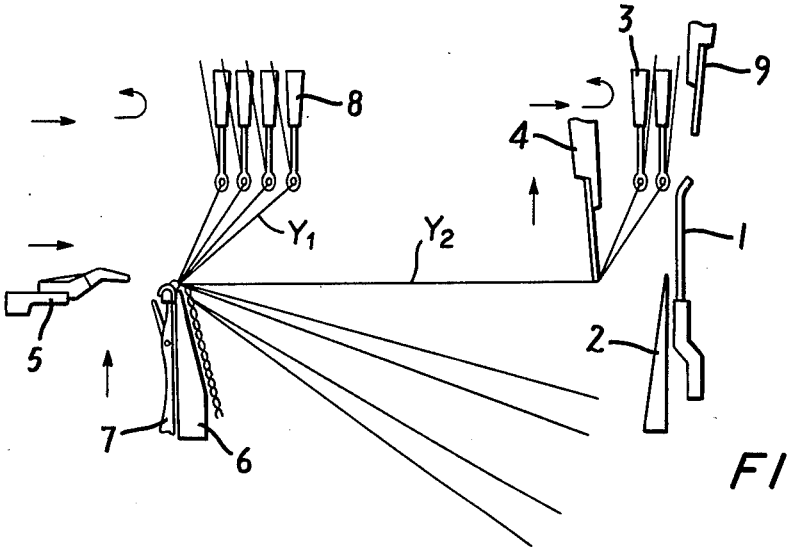
Figure 2:
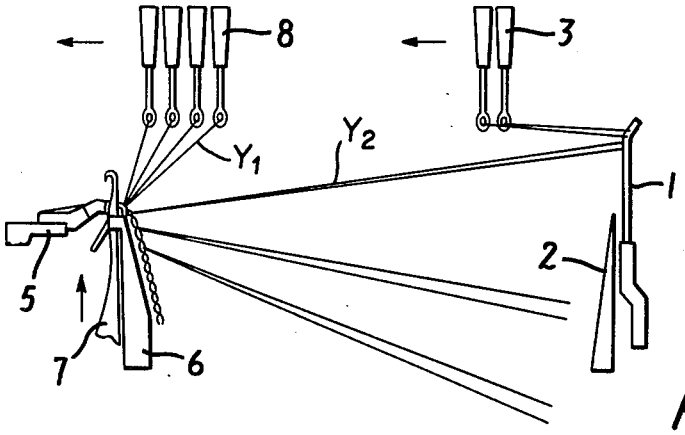

FIG. 1 shows the situation where the knife pointed bar has been elevated and stopped at the uppermost position in the supply process of pile yarns $Y_2$, in which the guide bars 3 for pile yarn moves foreward (right in the drawing) accompanied by the rear dropper and, immediately after passing the interval between the points of the knife pointed bars, stop and slide one point thus hanging the pile yarns $Y_2$ on the knife as shown in FIG. 2, while the rear dropper 4 keeps the lowest position in order to make sure the complete hanging of the pile yarns $Y_2$ on the knife-pointed bar and, after it is completed, start rising. At the same time, the sinker bar in the position of ground-stitch knitting in the warp knitting machine starts moving towards the top of the needle bed 6 as shown by the arrow in FIG. 1, and, after is has reached the needle bed 6, the latch needle bar 7 starts rising, the stitches (F) already formed being pressed down by the sinker bar 5. The latch of the latch needle will consequently be opened by the stitch just formed, and the stitch slides down over the spoon (tip) of the latch as the latch needle 7 further rises. Then the latch needle stops at the uppermost position. While, the guide bars 8 for forming ground stitches move in the direction shown by the arrow, namely left in FIG. 2.

Figure 3:
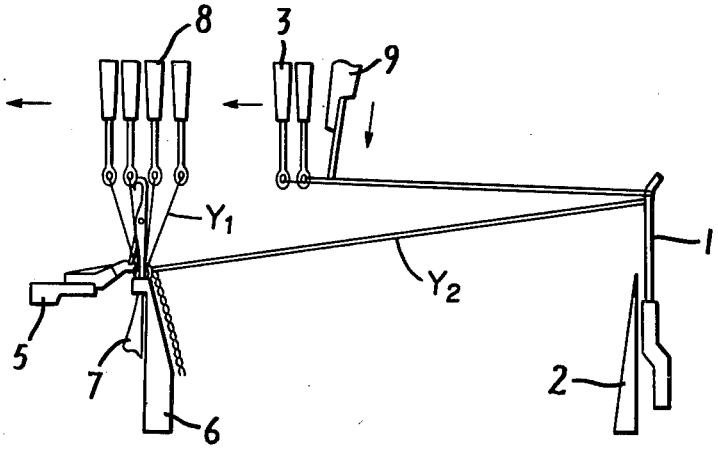
Figure 4:
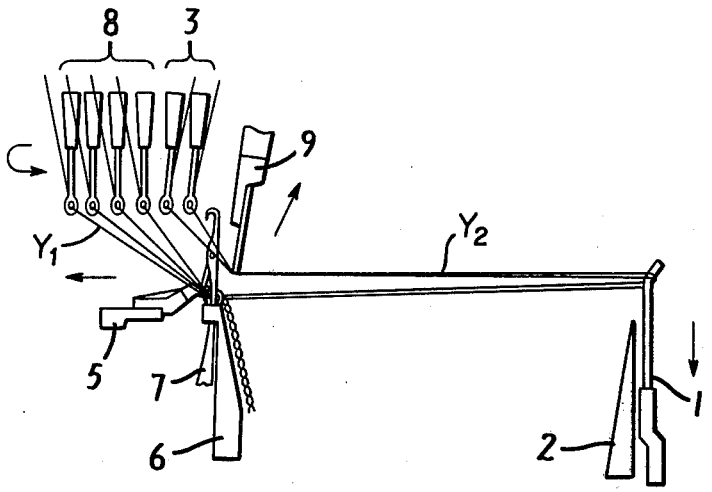

In FIG. 3, the sinker bar stays at the position mentioned above and the guide bars 3 for pile yarn move backward followed by the front dropper 9 which has begun to lower. The guide bars 8 for forming ground stitches also move backward and, when the guides 3 has reached the farthermost position, that is, about 3 mm back of the hook of the latch needle 7, all the guide bars stop the backward motion as shown in FIG. 4. Meanwhile, base yarns $Y_1$ and pile yarns $Y_2$ supplied separately (not shown) through guides 3, 8 pass through the interval between the latch needles, and the front dropper 9 stops at the lowest position. When the guides 3 for pile yarn have passed through the interval between the latch needles (7), each guide bar makes sliding to effect the overlapping on the latch needle.

Figure 5:
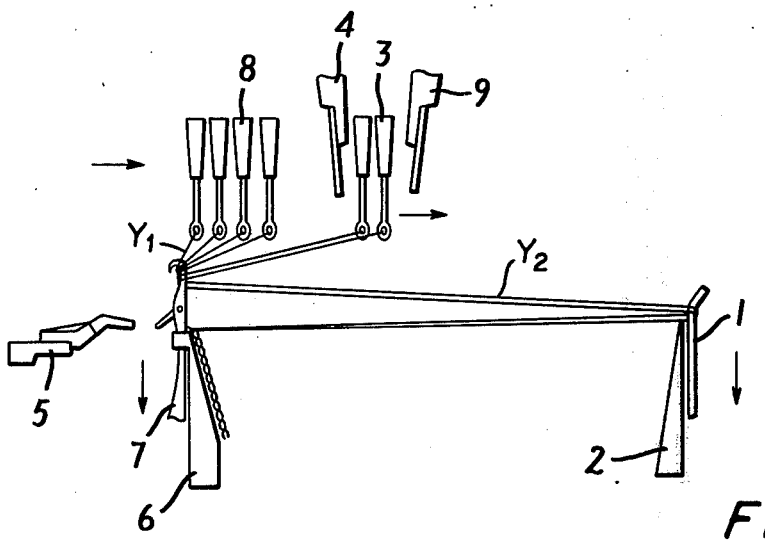
Figure 6:
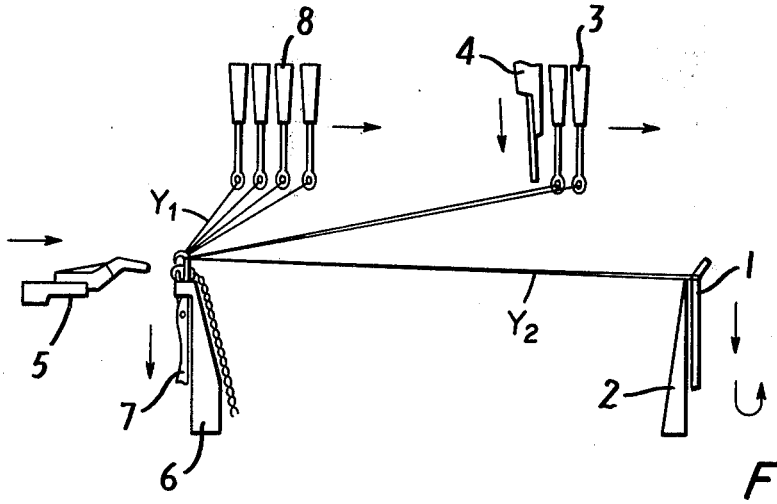

FIG. 5 and 6 show the aspect of the guide bars 3, 8 for forming ground stitches and for pile yarn having turned and swinging forward, in which each of base and pile yarns $Y_1$, $Y_2$ hanging on the needle through a guide bar slides into the hook of the latch needle 7, the latch needle keeping the uppermost position; thus, the overlapping on the latch needle will be complete. Then the front dropper 9 gradually arises, the sinker bar 5 moves backward from the top of the needle bed 6, an the knife pointed bar 1 begins to sink. The latch needle 7 goes down, and the ground stitch that has been formed slides upward along the foot of the needle, thus closing the latch, and further, after sliding over the latch and the hook of the needle, is pulled over the needle bed towards the winding-up means and formed into final shape and size by the tension of winding-up and yarn supply. Yarns hanging on the hook of the needle are pulled by the needle, which has lowered to the lowest position, and form a new stitch. On the other hand, the knife pointed bar 1 continues the quick downward motion as soon as the knock over is complete, thus cutting the pile loop to form pile. Then, the knife pointed bar begins to rise again and the rear dropper 4 to lower, preparing for the next loop forming.

A warp knitted pile fabric according to the invention will be knitted by the repetition of above steps.

The warp knitting machine used in the method of the invention, of which merely an operational outline of relevant parts has been described above, is similar to known knitting machines in the mechanism of knitting ground stitches, but an improvement has been made in order to adapt to the embodiment of the invention. The essential construction of the warp knitting machine used in the embodyment of the invention is characterized in that one of two latch needle bars is provided with a long-pile cutting mechanism with a knife pointed bar or with a slide cutter together with a hook needle unit.

In the former case of using a knife cutter, it tends that the cut pile ends rebound simultaneously with cutting toward the position where ground stitches are being formed because of a tension of the pile yarn usually required for knife cutting, thus being knitted into adjacent stitches, and that an uneven pile length is obtained due to the weak knitting force for knitting the pile yarn into the ground stitches because of no tension condition caused by cutting in every cycle. Therefore, this mode of cutting is unsuitable for a fine denier pile yarn which is apt to cause such condition, and the latter method of using a slide cutter with a hook needle unit is desirable for fine denier pile yarns.

Figure 10:
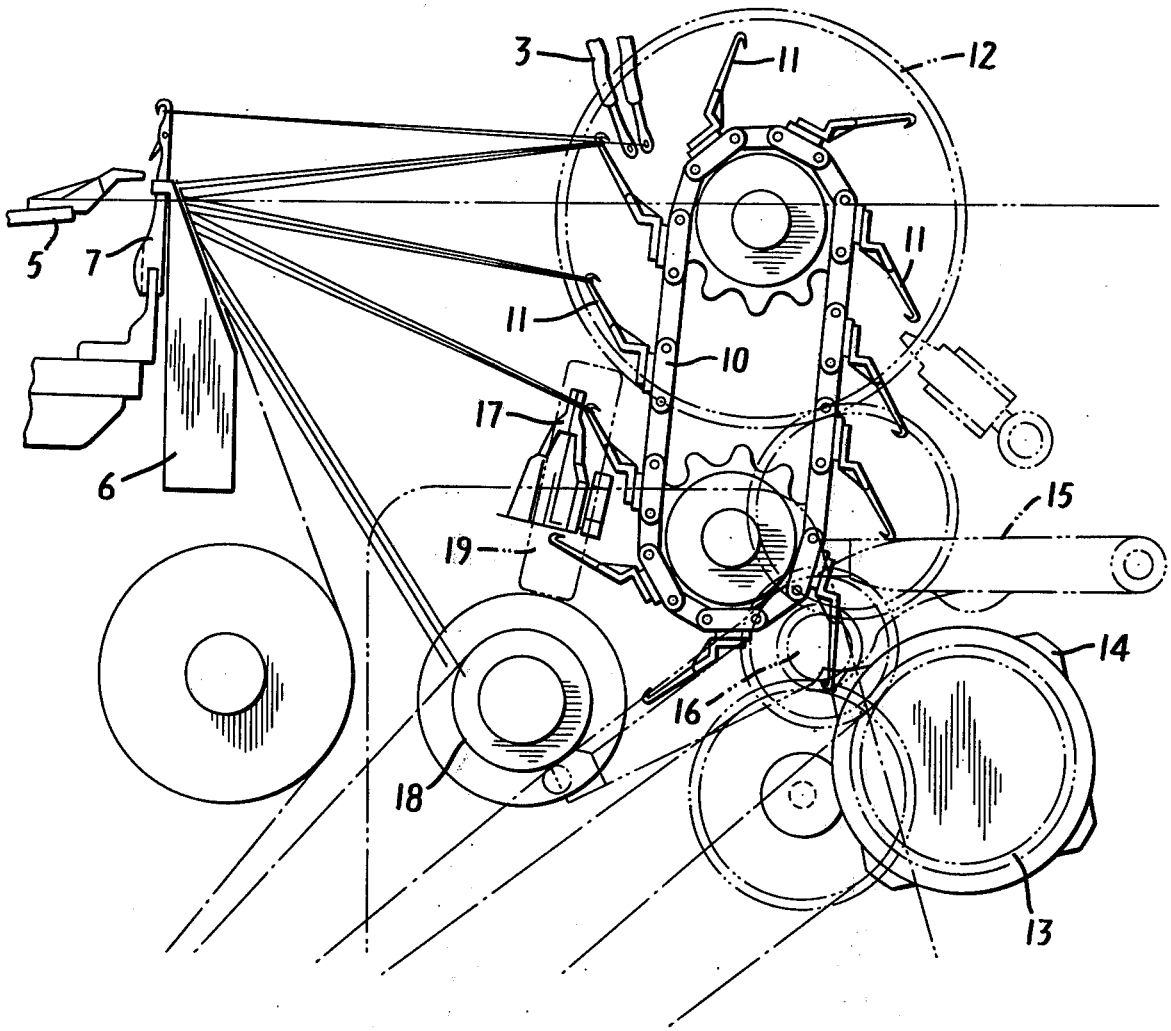
FIG. 10 is a schematic side view showing a modification of the long-pile cutting device shown above as the knife-pointed bar.

According to the method using a slide cutter, it is possible to cut pile yarns under the condition of no tension several cycles later, without necessitating the cutting in every cycle. The mechanism of the slide cutter method is shown in FIG. 10, in which pile yarns are hung during desired cycles on the hook needle 11 on the block which is fixed to a pair of conveyer chains provided on both sides of the knitting width and, after the cycles have been completed, the chains 10 are advanced one pitch and the next cycle of yarn hanging is continued.

The selection of the cycle is effected by the action of an intermittent lever 15 which is actuated by a projection of a point link 14 built in a point drum 13, the action being transmitted through, in turn, transmission gears 12 to shift the conveyer chains 10 one pitch. Thus, the next hook needle block is set at the yarn supply position and the next yarn supply is commenced. When the hook needle has advanced two pitches with pile yarns hung to the hook, the yarns will be inserted into a comb-shaped slide cutter 17, which is effected by the eccentric motion of a transmission gear 19 driven through a transmission gear 18 by the point link 14 built in the point drum 13. In the slide cutter method, therefore, the pile length is determined by the location of the cutter relative to the ground-stitch forming unit.

It is essential in the warp knitting machine for embodying the knitting method of the invention to provide guide bars for pile yarns separately from the group of guide bars for knitting ground texture i.e., base fabric, movably in their own back-and-forth motion in order to form long pile, and, preferably, with droppers in front and back of them to make sure the supply of pile yarns. Thus, the warp knitting machine must have each of such elements as guide bar for pile yarn, pile cutting mechanism, pile setting plate, and, preferably, dropper for yarn-supplying, besides the latch needle bar, needle bed, sinker bar, and guide bar for supplying base yarn, which are similar to those of a known warp knitting machine. For driving these mechanisms, a double disk cam and eccentric cam system is adopted, and the lateral shifting of each guide is effected by a mechanism such as pattern link. However, it is a matter of course that the invention is not limited to those driving mechanisms, but various modifications may be made.

The length of pile made by above described warp knitting machine is determined by the distance between needle bed and pile set plate, and the change of it is usually effected by moving the pile set plate, since the needle bed is fixed by reason of the mechanism of the warp knitting machine, so that the swinging motion of the guide bars for pile yarn must be changed accordingly.

Figure 11:
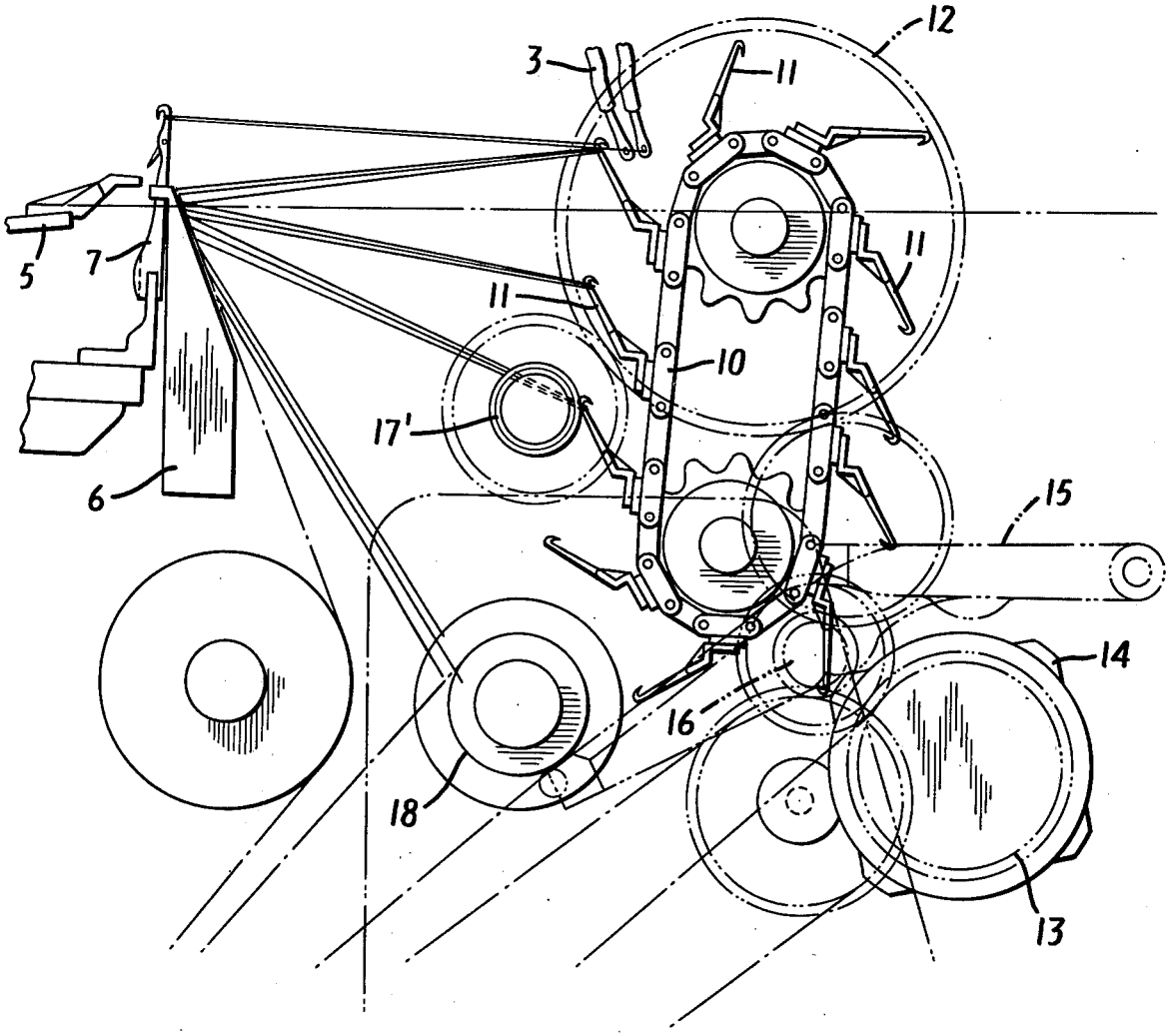
FIG. 11 is a schematic side view showing another modification of the long-pile cutting device.

FIG. 11 shows another modification, in which rotary disk blades (17') are used in place of the slide cutter in the slide cutter method deseribed above, and the operational mode is similar to that illustrated in FIG. 10 except that the disk blades are rotated by the power from the transmission gear so as to cut the yarns under a condition of no tension at the interval between two adjacent guides.

Figure 9:
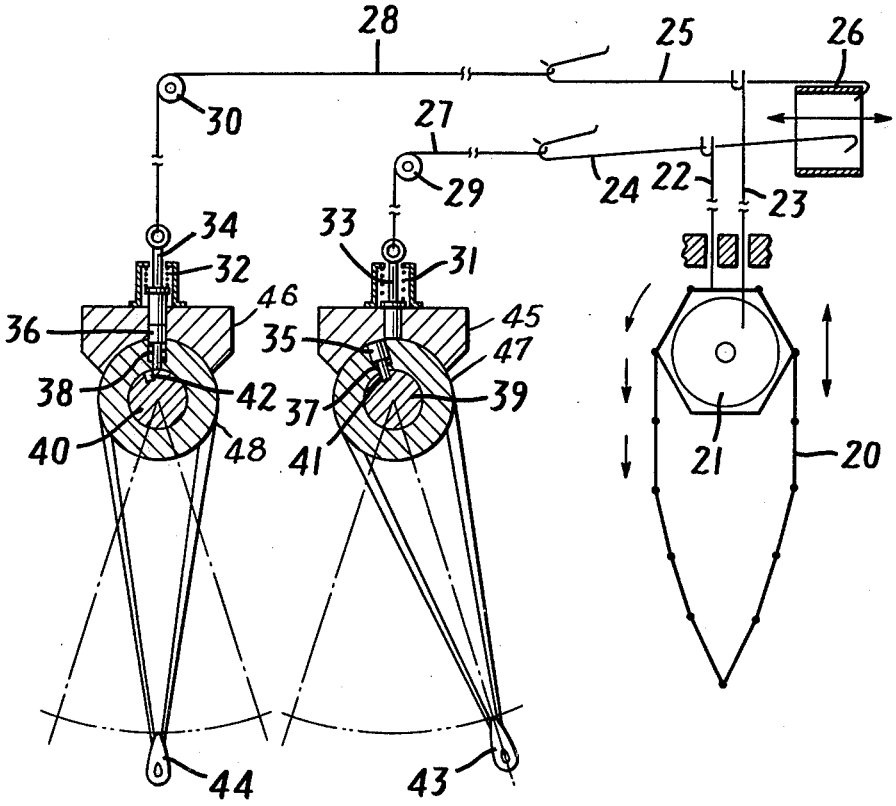
FIG. 9 is an operational illustration showing the outline of the yarn supply mechanism of the pile forming using the punch card shown above.

FIG. 9 illustrates a method that enables the formation of pile in a desired pattern, in which the supplying of pile yarns can be made partially in lateral direction according to the pattern, in contrast to the method described above, in which only a in sheet-like pile formation is possible because, in lateral direction, only a simulutaneous yarn supply can be made, although an intermittent supply in longitudinal direction may be made.

In FIG. 9, the guide points which are to supply yarns according to the pattern are swung front to back and then into over lapping motion, while the guides at rest are detained at the nearest position from knock over points, that is, the top of the needle bed, so as not to hinder the swinging motion of other guides for ground stitch formation and for pile yarn. The motion of the guides is controlled by a punch card through a check point device, and the lateral shifting of the guides at over lapping and under lapping is effected by a chain link drum.

Figure 7:
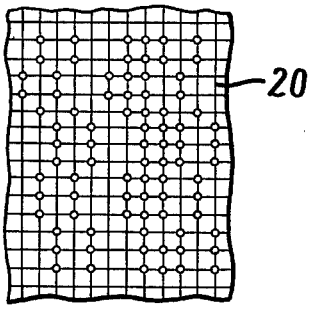
FIG. 7 and FIG. 8 are views each showing an example of punch card used for pile forming of a given pattern.
Figure 8:
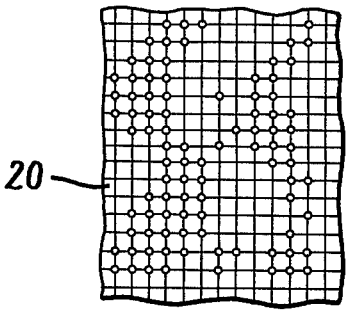

FIG. 7 and 8 show examples of the punch card to be used, in which a black spot represents the point at which pile yarn is not to be supplied. A punch card is made for each cycle of yarn supply according to a given pattern, the point which indicates the rest of a guide being punched (black spot).

The punch cards, thus made, are assembled in an endless band as shown in FIG. 9 and hung on a hexagonal rotary cylinder (21). The mode of pile formation using a given pattern is as follows.

When a punch card 20 has revolved onto the top side of the hexagonal rotary cylinder 21 by the rotation of the cylinder and has been elevated with it, a vertical rod 23 which has dropped into a punch hole of the punch card 20 stands unmoved (right one in the drawing), while a vertical rod 22 which is located at a position not punched in the card 20 is pushed upward by the card. The top of each vertical rod 22, 23 is U-shaped and bears a horizontal rod 24, 25 in the U-shape. One end (right side) of each horizontal rod (24), (25) is hooked, and a slider 26 is provided near the hooks of the horizontal rods movably in a right and left direction. If a vertical rod is pushed up, the corresponding horizontal rod is elevated thereby going out of the working range of the slider 26. The other end of each horizontal rod 24, 25 is connected through a cable 27, 28 passing over a guide 29, 30 to a stopper 33, 34. The stopper 33, 34 is inserted with its lower portion into the upper pin hole of a guide member 45, 46 having an arcuate concave surface to receive a ring member 47, 48 for supporting a yarn guide 43, 44 and is pressed against the ring member by a spring 31, 32. The ring member is mounted on a swing shaft 39, 40 and has a lower pin hole in radial direction, in which a push pin 35, 36 is accommodated together with a spring 37, 38.

The push pin 35, 36, as shown in FIG. 9, is pushed upward by the spring 37, 38. When the stopper 33 is in its lower position as shown in FIG. 9, a reduced lower end portion of the push pin 35 is pushed into a hole 41 in the swing shaft 39, thereby coupling the ring member 47 with the swing shaft. When the stopper 34 is pulled up by the cable 28, the push pin 36 is pushed up by its spring 38 so as to enter the upper pin hole in guide member 46 and be disengaged from hole 42 in the swing shaft 40. Thus the push pin 35, 36 effects, in co-operation with the stopper in the upper pin hole, the junction of the ring member to or disconnection of it from the swing shaft, thereby permitting the swing motion of the yarn guide or idling of the swing shaft. Therefore, if a vertical rod meets a position not punched in the card 20 as shown in FIG. 9 by the left one 22, it will by pushed up, consequently followed by the elevated horizontal rod with the hook isolated from the slider 26, the stopper 33 keeping the pushed down position and thereby pushing the push pin 35 into a pin hole 41 of the swing shaft 39, so that a junction between the ring member and the swing shaft 39 is effected to let the yarn guide 43 swing back-and-forth. If a vertical rod meets a punch hole in the punch card 20 as shown in FIG. 9 by the right one 23, it will drop into the hole and keep its lowered position, so that the horizontal rod 25 keeps the engagement with the slider 26 and pulls the stopper 34 up against the spring 32 because of the slider 26 having moved right. The push pin 36 is, accordingly, pushed up into the upper pin hole of the ring member by the spring, thereby disconnecting the ring member from the swing shaft 40, so that the shaft continues idling and the yarn guide 44 rests at a given position without swinging.

The rotary cylinder 21 then moves down together with the endless band of punch cards hung thereon so that the vertical rods 23 which have been inserted into the punch holes are drawn out of the holes while the rods 22 which have not been inserted into punch holes follow the cylinder down until the corresponding horizontal rods 24 are in position to engage the slider 26. Downward movement of the vertical rods 22, 23 is limited by suitable stops (not shown) or by engagement of the horizontal rods with the slider 26. When the rotary cylinder has moved down, it then rotates one pitch so that the next punch card comes on the top of the hexagonal cylinder, whereupon the next cycle beings. The cycle of operation of the patterning mechanism of FIG. 9 naturally corresponds to the cycle of motions around the needle bed.

The sequence of movements in one cycle of the pile yarn patterning mechanism of FIG. 9 is summarized as follows:

1. A punch card 20 is elevated together with the rotary cylinder 21, pushing up some of the vertical rods 27 (unpunched points) so as to disengage corresponding horizontal rods 24 from the reciprocating slider 26.
2. The slider 26 moves to the right, thereby pulling the horizontal rods 25 corresponding to the vertical rods 23 which have not been lifted (punched points), thus disconnecting the ring members 48 of yarn guides from the swing shaft.
3. Yarn guides (except the disconnected ones) swing one cycle of swinging motion.
4. The rotary cylinder goes down together with the punch card and disengages the vertical rods from the card.
5. The rotary cylinder rotates one pitch to bring the next card on top.

Thus, a warp knitted pile fabric having pile distributed according to a desired pattern is obtained, the formation of pile being controlled by the existence of punch holes in punch cards.

In FIGS. 1 to 6, a set of two guide bars is shown for use in guiding the pile yarn, but the object may also be attained by using only one guide bar if the number of yarns to be passed through a guide is increased, and it is preferable to use one guide bar, particularly, in the method using punch cards for the purpose of simplification of the mechanism.

By using the method of the invention, as disclosed above, it is possible to form far longer pile than conventional one and to change the pile length easily, in contrast to the pile formation by conventional pile knitters, and thus warp knitted pile fabrics having pile of variable length in a wide range of 3 to 50 cm is obtained.

The knitted pile fabrics obtained according to the invention, in particular, have a wide use in ornaments, carpetings, further by giving a secondary processing, in imitation hair, wigs, jackets, hoods, capes, sweaters, boots, false mustaches and beards, toys, etc.

Having described out invention as related to the embodiments shown in the accompanying drawings, it is our intention that the invention be not limited by any of the detail of description, but rather be construded broadly within its sprit and scope as set out in the accompanying claims.

What is claimed is:

1. A Warp knitting machine for knitting long-pile fabrics, comprising means for knitting ground stitches including latch needles and guide bars for ground yarn, guide bars for pile yarn provided separately from the guide bars of said means for knitting ground stitches, and means for cutting pile loops provided at a variable distance in front of said means for knitting ground stitches and including a pile cutting device and a hook needle unit comprising a plurality of hook needle blocks attached to endless conveyer chains and movable in an endless intermittent revolution, said guide bars for pile yarn being movable in a swinging motion back-and-forth between the rear of the position where ground stitches are formed and the front of a hook needle block of said hook needle unit so as to dispose pile yarns between the latch needles of the means for knitting ground stitches and the hook needles on the hook needle block thus to incorporate the pile yarns into the ground stitches in the form of pile loops, said hook needle unit being operable to hang said pile yarns on hook needles on a hook needle block and to shift one pitch after a knitting cycle is completed to set the next hook needle block in position, and said pile cutting device being operable to cut the pile loops under a tension-free condition at least one cycle later than the loop formation.

2. A warp knitting machine for knitting long-pile fabrics as claimed in claim 1, wherein said pile cutting device is a slide cutter.

3. A warp knitting machine for knitting long-pile fabrics as claimed in claim 1, wherein said pile cutting device is a rotary disk cutter.

4. A warp knitting machine for knitting long-pile fabrics as claimed in claim 1, wherein each of said guide bars for pile yarn comprises a plurality of yarn guides grouped into a number of groups in the lateral direction of the fabric to be knit, said group of yarn guides being operable to move in said swinging motion and to be controlled individually with respect to their stop and motion, so that pile loops are formed selectively on the ground stitches.

5. A warp knitting machine for knitting long-pile fabrics as claimed in claim 4, which further includes control means for controlling said individual motion of said groups of yarn guides by means of punch cards punched according to desired patterns.

6. A cyclical process of manufacturing knitted long-pile fabrics, a cycle of which comprising steps of hanging pile yarns interengaged to the ground stitches on hook needles on a hook needle block a hook needle unit provided at a distance in front of the means for knitting said ground stitches by means of guides for pile yarn swung forward to the hook needles, hanging the pile yarns on the latch needles of the means for knitting ground stitches by means of the guides swung backward to the latch needles, engaging said pile yarns to the yarns for forming ground stitches by the down motion of said latch needles into the ground stitches to form pile loops, advancing the hook needle block one pitch and setting the next hook needle block in place to receive pile yarn, and cutting the formed piles under a tensionfree condition at least one cycle later than the loop formation.

7. A process of manufacturing knitted long-pile fabrics as claimed in claim 6, wherein said guides for pile yarn are grouped into a number of groups in the lateral direction and wherein the stop and start of the swinging motion of said guides are controlled independently with respect to the individual groups so that said pile loops are formed selectively on the ground stitches.

8. A process of manufacturing knitted long-pile fabrics as claimed in claim 7, wherein said pile yarn are cut at a length of more than 10 cm. from the points at which said pile yarns are interengaged with the ground stitches of the fabric.

* * * * *